United States Patent [19]

Bigbie et al.

[11] Patent Number: 4,541,490

[45] Date of Patent: Sep. 17, 1985

[54] ADAPTER FOR A WELLHEAD

[75] Inventors: Burke N. Bigbie, Hobbs, N. Mex.; Gilbert R. Boyd, Waxahachie, Tex.

[73] Assignee: Joy Manufacture Company, Pittsburgh, Pa.

[21] Appl. No.: 529,305

[22] Filed: Sep. 6, 1983

[51] Int. Cl.[4] ..... E21B 33/04

[52] U.S. Cl. ..... 166/379; 166/84; 166/88; 285/144

[58] Field of Search ..... 166/379, 84, 85, 86, 166/88, 81-83, 75 R; 285/16, 144, 146, 148

[56] References Cited

U.S. PATENT DOCUMENTS

| | | | |
|---|---|---|---|
| 1,857,101 | 5/1932 | Nixon | 285/144 |
| 1,861,755 | 6/1932 | Rasmussen | 285/144 |
| 1,868,119 | 7/1932 | Segelhorst | 285/144 |
| 1,926,856 | 9/1933 | Leman | 166/88 |
| 2,284,869 | 6/1942 | Hinderliter | 285/144 |
| 2,312,487 | 3/1943 | Roach et al. | 166/88 |
| 2,315,134 | 3/1943 | Roach et al. | 285/144 |
| 2,402,723 | 6/1946 | Bean | 285/144 |
| 2,746,781 | 5/1956 | Jones | 166/82 |
| 2,754,136 | 7/1956 | Phillips | 285/144 |
| 3,084,745 | 4/1963 | Floyd | 166/89 |
| 3,168,337 | 2/1965 | Johnson et al. | 285/140 |

*Primary Examiner*—Stephen J. Novosad
*Assistant Examiner*—Hoang C. Dang
*Attorney, Agent, or Firm*—Edward Levine

[57] ABSTRACT

Improved wellhead structure and method for modification of commercially operating wellheads. Screwed type wellheads include an adapter attached to a body extending upwardly from a well bore. The adapter supports a stripper rubber and a slip assembly on internal shoulders. An upper shoulder supporting the slip assembly and a lower shoulder supporting the stripper rubber extend radially into the central bore of the adapter a selected distance allowing unencumbered removal and reinsertion of the stripper rubber through the top portion of the adapter while the adapter is affixed to the body. Barrels radially extending from the adapter wall contain hold down screws extendable into the bore to selectively restrict upward motion of the stripper rubber.

5 Claims, 4 Drawing Figures

ADAPTER FOR A WELLHEAD

BACKGROUND OF THE INVENTION

This invention relates to wellheads and to apparatus providing capability for removal and insertion of wellhead stripper rubbers through a blowout preventer, such apparatus being more particularly useful as a workover tool for conversion of existing wellheads to units having enhanced reworking capabilities.

Superatmospheric pressures exist, or may be suddenly encountered, in many wells, such as oil and gas wells, and accordingly drilling and producing operations must be carried out while the pressure in the well bore is confined. Blowout preventers are used on many wells which include devices being capable of sealing the annular space between an inner and an outer pipe or casing. Such blowout preventers are not a permanent portion of a wellhead and if wells are under pressure, then blowout preventers are positioned on a wellhead prior to reworking of the well, which blowout preventers are subsequently removed and used on another well to be reworked.

When reworking is required on a well, for example of the type requiring removal of a tubing string, wells with pressure not having an effectual stripper rubber must either be provided with a stripper rubber or killed. If a well with pressure or having the possibility of being with pressure is to be reworked, a blow out preventer is also utilized during the reworking operation. Installation of a stripper rubber in a wellhead requires killing of the well unless the stripper rubber can be installed through an in place blowout preventer. Killing a well, that is, the process of feeding a fluid such as water down into the well bore to provide a pressure head, is undesirable as a result of the time and expense involved in the operation. Additionally, there is an ever present possibility that a well which has been killed cannot be revived, ending its useful production life.

Even when blowout preventers are used, if a stripper rubber is unavailable the operation can be undesirably time consuming and cause wear on the components involved. Proper pulling of a tubing string through a blowout preventer on a live well requires having a stripper type apparatus. Without a stripper apparatus such pulling involves, for example, opening of a bottom one of a pair of rams, movement of the tubing collar passed the open bottom ram, closing of the open ram and opening of an upper of the pair of rams, and further upward movement of the tubing coupling through the upper ram which is subsequently closed. This operation must be continuously repeated.

Pulling of tubing is preferable with a stripper rubber in place, as the stripper rubber functions to retain pressure by sealing against the tubing, and it also performs a cleaning function, stripping deposits from against the tubing. Only when the last joint of tubing is pulled uwpardly through the blowout preventer must the sequential opening and closing of the pair of rams be utilized. During pulling of the balance of the tubing string, contact between the stripper rubber and tubing, including the coupling, retains the pressure below the stripper rubber. In this operation, however, the stripper rubber is subjected to high wear as each coupling is pulled through the stripper rubber, continually flexing the stripper rubber. Because of this wear, the stripper rubber needs to be removed and replaced as part of the reworking operation.

In most producing wells removal of the stripper rubber is difficult, requiring killing of the well. Although some wellheads, and particularly many so called flange type wellheads, allow removal of a stripper rubber through an in place blowout preventer so that killing of the well is not required, a large number of commercially producing wellheads do not provide such removal and replacement capabilities. In particular, the most common of the so called threaded or screwed type wellheads have included a design whereby a stripper rubber is seated in a casing or tubing body or head and a stripper attachment threadedly attached to the head includes an interior shoulder overlapping the top surface of the stripper rubber. Thus, the stripper rubber can only be removed from the head subsequent to removal of the attachment from the head, which cannot be performed with a blowout preventer in place due to the configuration of the attachment. Accordingly, wells of this type must be killed for proper repair or other reworking activities. Prior to the instant invention, the capability for a relatively simple manner in which to convert the large number of field operating production screwed type wellheads to units allowing stripper rubber insertion or removal though a blowout preventer has not existed.

It is thus desirable to provide wellhead apparatus which allows reworking of the wellhead without requiring killing of the well. It is also desirable to provide such structure which allows removal and insertion of a stripper rubber into the wellhead through an in place blowout preventer. It is further desirable to provide a method whereby existing production wells not having the capability for stripper rubber replacement through an in place blowout preventer can be readily modified to have such capability. As flanged wellheads, compared to screwed wellheads, are particularly expensive, generally heavier and more massive then screwed wellheads, it is particularly desirable that such method and apparatus be available with screwed, as opposed to flanged, wellhead apparatus.

SUMMARY OF THE INVENTION

This invention provides apparatus for facilitating wellhead opertions including method and structure for the modification of existing screwed type production wellheads which do not have the capability for removal of a stripper rubber through a blowout preventer readily into wellheads having such capability. Thus, instead of having to kill a well each time reworking is performed, a well need only be killed one time to make the modification, and subsequent operations will not require detrimental killing of the well.

In preferred form a wellhead body portion, such as a tubing head, includes a male threaded top to which is sealingly secured a female threaded adapter. The interior bore of the adapter includes, from top to bottom, three sections of progressively decreasing diameter, such that an upper shoulder and lower shoulder are formed within the adapter. A stripper rubber seats on the lower shoulder and is maintained in position against the upwardly directed well pressure by a plurality of radial hold down screws. The screws are housed in barrels which removably or fixedly extend laterally from the adapter wall. Removable barrels allow for relative ease of replacement in the event that the threads attaching the barrels to the adapter wall or the threads about the hold down screw become worn or corroded in the operating environment. Removal of the barrels can also facilitate reworking operations and attachment of chains or other tooling. Additional discussion of the removable barrels is provided in the below cross-referenced application.

A slip assembly is positioned within the adapter above the stripper rubber, and is seated on the upper shoulder. Threadedly secured to the top of the adapter is a top piece such as a top nut which restrains against upward pressure within the wellhead and which seats packing rings or other sealing means positioned atop the slip assembly.

Thus, upon removal of the top piece and packing, the slip assembly, and particularly the stripper rubber upon retraction of the hold down screws, can be removed upwardly from the adapter and passed through a blowout preventer. Moreover, existing wellheads not having such capabilities can be readily modified with a relatively minimal amount of new structure while reutilizing much of the structure existing prior to the modification.

CROSS REFERENCE TO RELATED APPLICATION

This disclosure is closely related to U.S. patent application Ser. No. 529,306 in the name of Bigbie et al entitled Wellhead System with Removable Self Sealing Stripper Rubber, filed concurrently herewith and hereby incorporated by reference.

BRIEF DESCRIPTION OF THE DRAWINGS

The advantages, nature and additional features of the invention will become more apparent from the following description, taking in connection with the accompanying drawings, in which.

DESCRIPTION OF THE PREFERRED EMBODIMENTS

Figure 1:
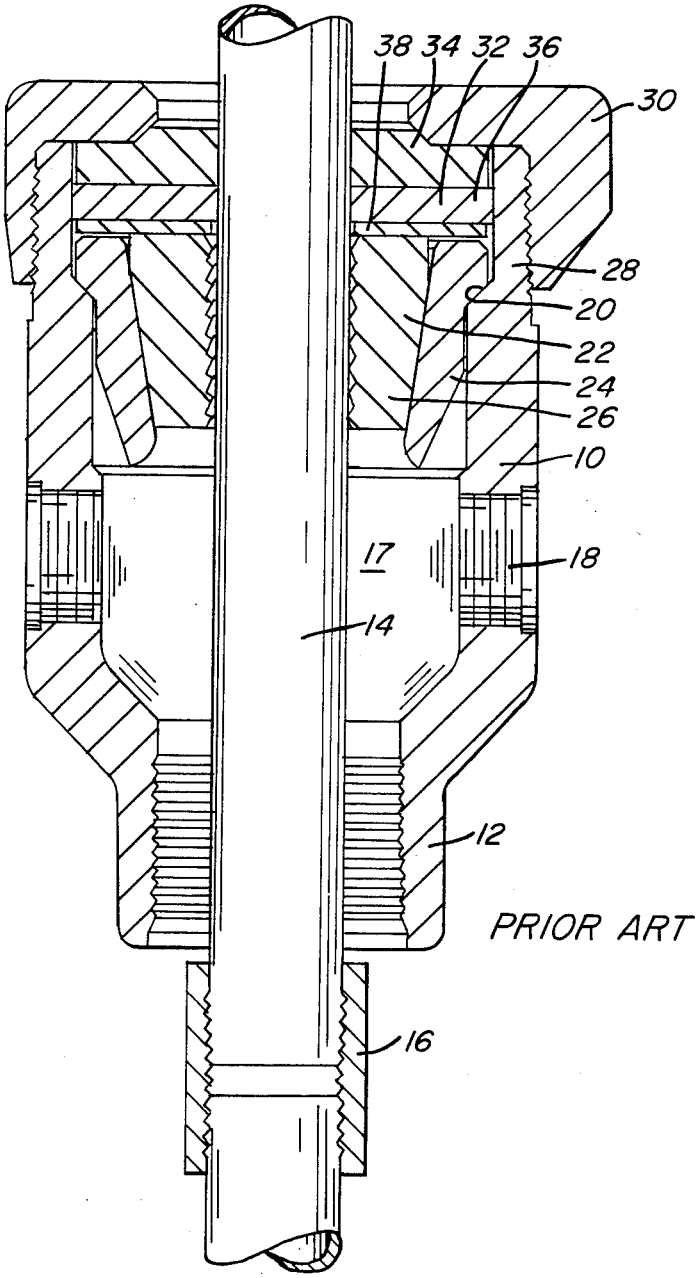
FIGS. 1 and 2 are elevation views, in cross section, of common prior art wellheads known respectively in the industry as a type R and a type SR wellhead.
Figure 2:
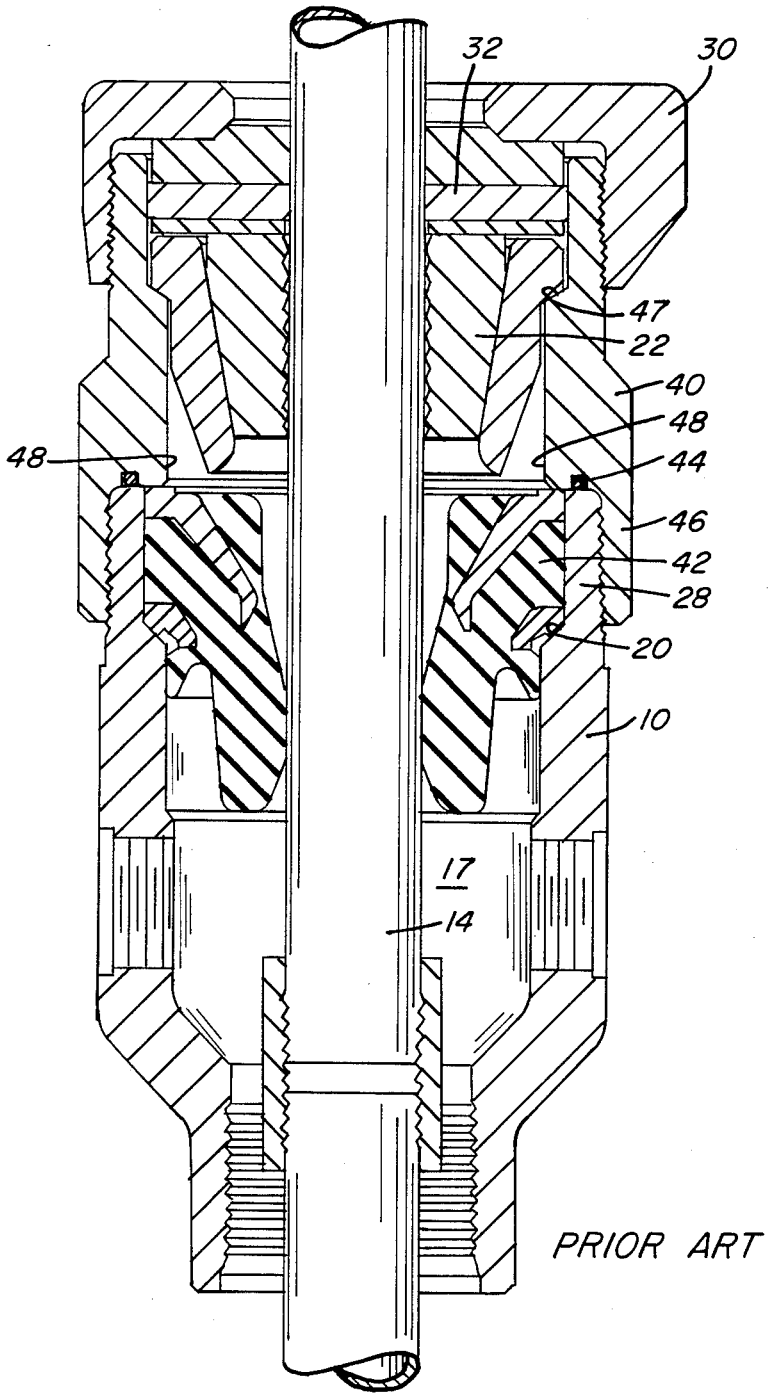

Referring initially to FIGS. 1 and 2 there are shown two screwed type wellheads commonly in use in production wells. The wellhead shown in FIG. 1 includes a bottom body or head 10 extending upwardly at the top of a well bore. It will be recognized that such heads 10 are commonly made with one of three types of bottom configurations 12, a female threaded connection as shown, a male threaded connection, or a slip joint welded connection. A conduit such as a string of production tubing 14 extends through the wellhead and into the well bore, which can, for example, convey a fluid petroleum product to an outlet. The tubing string generally includes couplings 16 joining thirty-foot tubing 14 sections. An annulus 17 is formed between the head 10 and the tubing 14. A connection is made between the bottom configuration 12 of the head 10 and other wellhead structures eventually transferring the load of the tubing string and wellhead components to the ground, such as a surface casing. The head 10 includes apertures 18 which can, for example, be used as outlets for gas production or inlets for brine water used to kill the well during a reworking operation.

Seated on a ledge 20 of the head 10 is a slip assembly 22 including a slip bowl 24 supporting hinged slips 26. The head 10 includes a male threaded top portion 28 to which matingly attaches a female threaded top nut 30. Disposed between the slip assembly 22 and the top nut 30 are packing means such as a packing 32 including a metallic top packing ring 34, an intermediate rubber packing ring 36, and a metallic bottom packing ring 38. The top nut 30 provides a downwardly acting force on the packing 32 and the packing 32 annularly seals the upper area of the head 10. The wedging interaction of the bowl 24 and slips effects gripping of the tubing 14 and maintains the elevation of the tubing 14.

The prior art wellhead shown in FIG. 2 includes in common with the wellhead of FIG. 1 certain components including the head 10, a slip assembly 22, the packing 32 and the top nut 30. It will be recognized that in field use the top nut 30 of both wellhead types is oftentimes replaced with additional components for attachment of further mechanisms such as blowout preventers, production valves, spools, siamese and frac adapters, and additional production heads.

The wellhead of FIG. 2 additionally includes an attachment 40, a stripper rubber 42, and a sealing O-ring 44. The attachemnt 40 includes a female threaded bottom portion 46 matingly sized to the top portion 28 of the head 10 so that the attachment 40 is threadedly secured to the head 10 and is sealed heretofore by O-ring 44. The slip assembly 22 seats on a ledge 47 of the attachment 40.

The stripper rubber 42 seats on the ledge 20 of the head 10, and is retained in position against upward movement by a rib 48 of the attachment 40. Pressure in the annulus 17 tends to force the stripper rubber against the periphery of the tubing 14, thereby creating a seal. Pressure forces also act to push the stripper rubber upwardly. The configuration of the rib 48, overlapping the stripper rubber 42, requires that the attachment 40 to removed from the head 10 in order to allow removal of the stripper rubber from the body.

Figure 3:
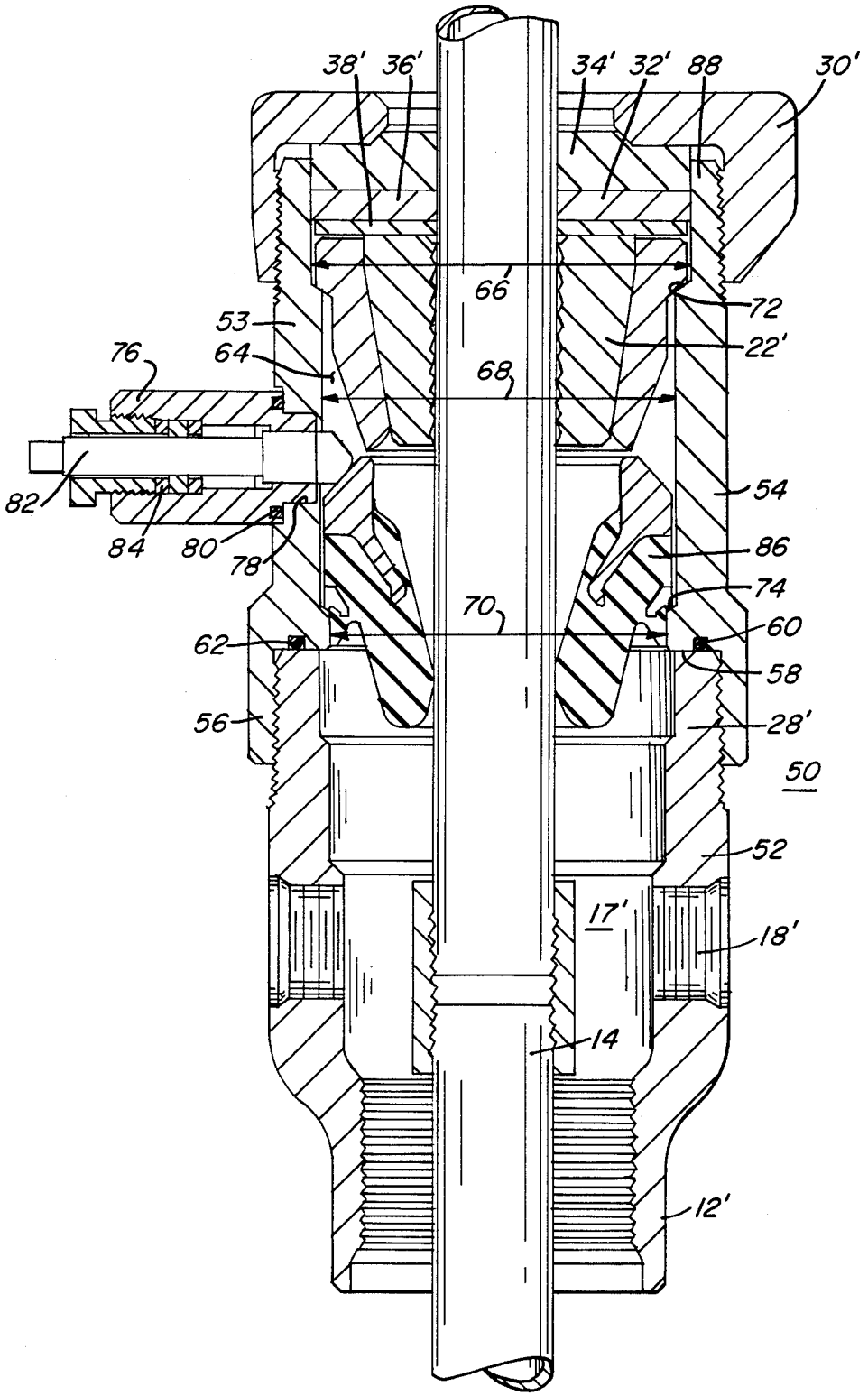
FIG. 3 is an elevation view, in cross section, of a wellhead structure in accordance with the invention.

Referring now to FIG. 3, there is shown an improved wellhead 50 in accordance with this invention. The wellhead 50 includes a generally cylindrical hollow body 52 extending upwardly at the top of a well bore. The body 52 in many instances will be an existing wellhead such as the head 10. As with the head 10, the body 52 includes a bottom configuration 12' of either a female threaded connection as shown, a male threaded connection, or a slip joint welded connection. Tubing 14 extends through the body 52, forming an annulus 17' in fluid communication with apertures 18'. The body 52 also includes a male threaded top portion 28'. Alternate thread arrangements can also be utilized.

Threadedly attached to the body 52 is an adapter 54. The adapter 54 is preferably of a generally cylindrical configuration having a wall 53 and interior bore 64. The adapter includes a bottom portion 56 having female threads for connection to the male threaded top portion 28' of the body 52. Also included are means for sealing the adapter 54 and the body 52, such as a groove 60 in a seating surface 58 which receives an O-ring 62. The adapter differs from, for example, a tubing head in that the adapter 54 does not have a production outlet port which is a part of a tubing head.

The interior bore 64 of the adapter includes three interior cross sectional dimensions or inside diameters.

The inside diameters of the bore 64 decrease from the top to the bottom of the adapter. Accordingly, an upper diameter 66 is larger than an intermediate diameter 68 which is larger than a lower diameter 70. This configuration forms upper means for seating a slip assembly 22', such as an upper shoulder 72, and lower means for seating a stripper rubber 86, such as a lower shoulder 74, within the interior bore 64 of the adapter. The peripheral dimensiion or diameter of the upper shoulder 72 is greater than that of the lower shoulder 74.

The preferred adapter 54 includes means for attaching a plurality of barrels 76 through the wall 53, such as threaded apertures 78. The interconnection of each barrel 76, which extends radially or laterally at an angle from the adapter, and the adapter 54, is sealed by an O-ring 80. The barrels 76, preferably four in number spaced at ninety degree intervals about the adapter 54, each contain an adjustable hold down screw 82 selectively extendable into the adapter bore 64. The hold down screws 82 are sealed to the barrels 76 through a packing 84. Additional advantages and structure associated with the removable barrels 76 are discussed in the cross-referenced application.

Seated on the lower shoulder 74 is the stripper rubber 86. The stripper rubber 86 is inserted into the adapter with the hold down screws 82 in a retracted position. Subsequently the hold down screws 82 are extended into the bore 64 and provide a means for restraining the stripper rubber 86 against upward motion from the influence of pressure in the annulus 17'. It will be noted that when the hold down screws are retracted from the bore, there is no structure obstructing insertion or removal of the stripper rubber 86 through an upper end 88 of the adapter 54.

Seated on the upper shoulder 72 is the slip assembly 22'. Preferably the upper interior diameter 66 and the configuration of the upper shoulder 72 is identical to that of the ledges 20, 46, (FIGS. 1 and 2) such that the slip assembly 22' can be identical with slip assembly 22. Affixed to the male threaded upper end 88 of the adapter is a female threaded top piece such a a top nut 30' which can be identical to the top nut 30. It will be recognized that such interconnections among component parts of the inventive structure, such as the body 52, adapter 54 and top nut 30', can be alternatively male threaded, female threaded or otherwise configured for interconnection. As with the interchangeability of the top nut 30, 30', a packing 32' including a top packing ring 34', an intermediate packing ring 36' and a bottom packing ring 38' can be identical to the packing 32. It will be recognized that for attachment of other structures, such as a blowout preventer, the top nut 30', packing elements 34', 36', 38' and slip assembly are removed and a top piece adaptably threaded to mate with the upper end 88 of the adapter is attached.

Figure 4:
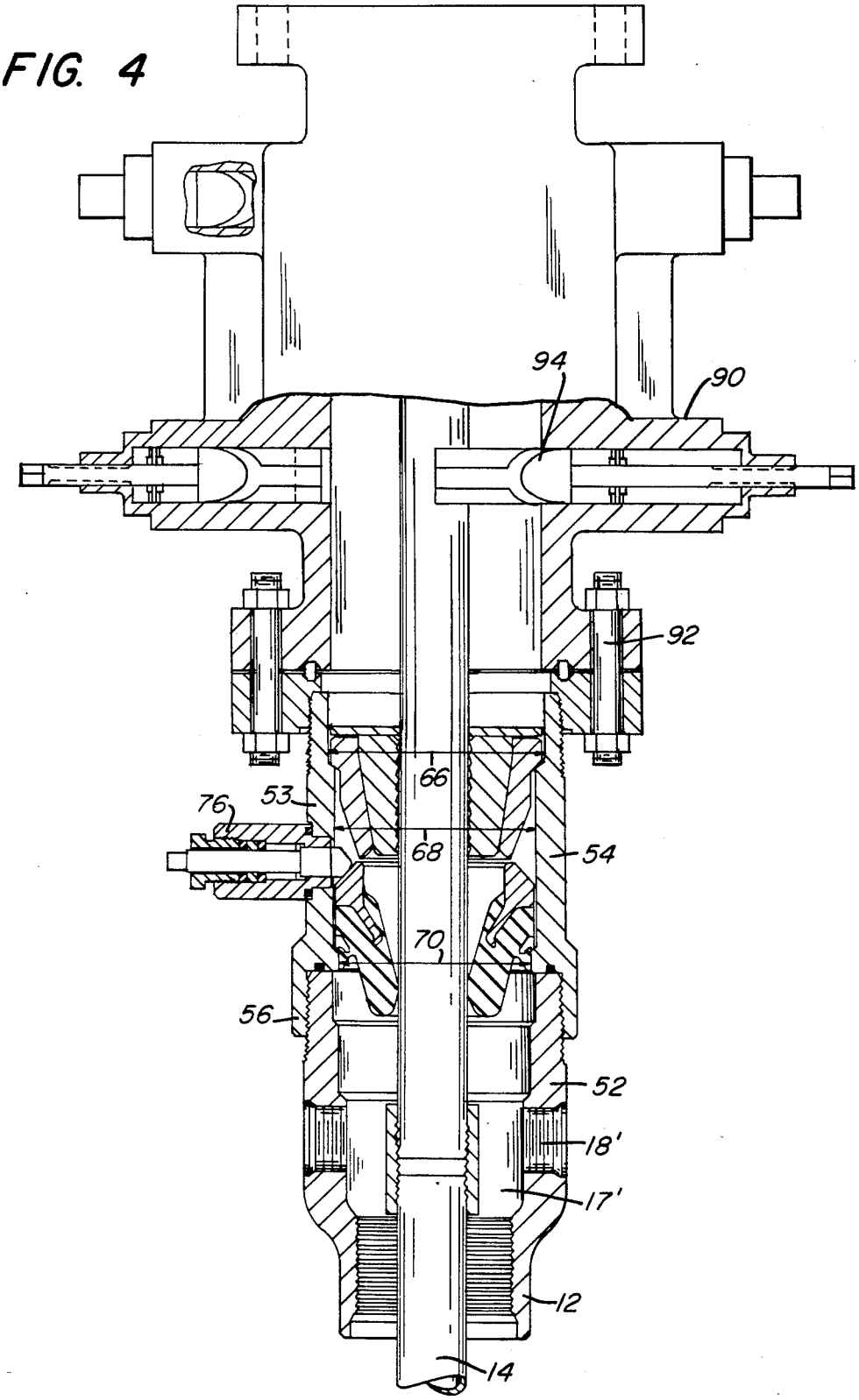
FIG. 4 is an elevation view, in cross section, of a wellhead structure in accordance with the invention including a blow out preventer.

It will now be apparent that with a wellhead 50 configuration of the type disclosed, the stripper rubber 86 can be removed from the wellhead through a blowout preventer affixed above the adapter 54, merely by withdrawing the hold down screws. FIG. 4 shows in simplified fashion a blowout preventer 90 affixed atop the adapter 54 by bolts 92. The blowout preventer is shown with lower rams 94 being retracted on the left hand side of the Figure and being inserted on the right hand side of the Figure.

It will also be apparent that existing production or other wells can readily be modified to structures having the benefits of the inventive wellhead 50. To modify an operational wellhead of the type shown in FIG. 1, the well will be killed once, and the top nut 30 or other top structure will be removed along with the packing 32, the slip assembly 22 and preferably the tubing 14. The adapter 54 is then affixed to the top portion 28 of the head 10. A new stripper rubber 86 is seated on the lower shoulder 74, the hold down screws are extended, and the original slip assembly 22 or a replacement is replaced onto the upper shoulder 72. The packing 32, if in functional condition, can also be re-used. A top piece, such as the original top nut 30, is affixed to the adapter 54. Modification of the type of wellhead of FIG. 2 is similar. The top nut 30, attachment 40, packing 32, slip assembly 22 and a stripper rubber 42 are removed and an adapter 54 is affixed to the head 10. If in good condition the slip assembly 22, packing 32, and top nut can be reused. The original stripper rubber 42 will require replacement. Extension of the hold down screws 82 restrains upward motion of the replacement stripper rubber.

Modifications and additions of the specific structures and methods disclosed are possible. For example, while it is necessary that the new stripper rubber be freely insertable in the bottom shoulder of the adapter and that an upper shoulder exist to support the slip assembly, such structures can be achieved with arrangements other than that of a three diameter interior bore. For example, fabricated shoulders or ridges can be welded or otherwise formed on the interior of the adapter. Additionally, it may be desirable in the field to prepare or rethread the top surface of the body, or even cut the surface to reduce the height, prior to affixing the adapter. Other modifications and additions can be contemplated without departing from the spirit of the invention. It therefore is intended that the foregoing description and Figures be taken as illustrative, and not in a limiting sense.

We claim:

1. Apparatus for facilitating screwed typed wellhead operations having a production tubing string comprising:

a head, having a radial production outlet port, extending upwardly from a well bore;

a continuous annular stripper rubber, self sealing with respect to said tubing and supportable within an adapter;

a slip assembly supportable within said adapter, said slip assembly and stripper rubber directly engaging the same production tubing string,;

said adapter being sealingly affixed to thread onto and extend upwardly from said head, and having upper means for supporting said slip assembly within said adapter and lower means for supporting said stripper rubber within said adapter in a manner such that said stripper rubber is selectively insertable into and removable from said adapter through the top of said adapter without obstruction by said adapter; and means radially insertable into said adapter for selectively restraining upward motion of said stripper rubber when said stripper rubber is supported on said lower support means, said selective restraining means including a plurality of removable barrels extending radially from said adapter, each said barrel having a hold down screw extendable into said adapter.

2. Apparatus for facilitating screwed type wellhead operations having a production tubing string comprising:

a head, having a radial production outlet port, extending upwardly from a well bore;

an adapter having a generally continuous wall perforated to receive restraining means, said adapter sealingly affixed to thread onto and extend upwardly from said head, said adapter having an upper interior cross section, an intermediate interior cross section and a lower interior cross section, said upper interior cross section being larger than said intermediate interior cross section so as to form an upper shoulder, said intermediate interior cross section being larger than said lower interior cross section so as to form a lower shoulder;

a continuous annular stripper rubber, self sealing with respect to said tubing, having an outer cross section larger than said lower interior cross section and smaller than said intermediate interior cross section, seated against said lower shoulder, said stripper rubber being selectively insertable into and removable from said adapter through the top of said adapter without obstruction by said adapter;

said restraining means including a plurality of removable barrels extending radially from said adapter, each said barrel having a hold down screw extendable into said adapter for restraining said stripper rubber against upward motion from said lower shoulder; and a slip assembly supported on said upper shoulder, said slip assembly and stripper rubber directly engaging the same production tubing string 3. An adapter for converting a screwed type wellhead of the type supporting production tubing through a generally cylindrical head having a radial production outlet port and extending upwardly at the top of a well bore and having one of male and female threads at the top thereof, a slip assembly seated on an interior ledge of said head and engaging said tubing, and a packing positioned between said slip assembly and a top member having the other of said male and female threads threadingly secured atop said head, said adapter comprising:

a generally cylindrical hollow adapter having a generally cylindrical wall and also having the other of said male and female threads at a lower end thereof for attachment to said threads at the top of said head, means for creating a seal between said adapter and said head upon attachment thereof, said adapter having an upper interior cross section, an intermediate interior cross section, and a lower interior cross section, said upper cross section being larger than said intermediate cross section, and said intermediate cross section beiing larger than said lower cross section so as to form an upper interior shoulder for supporting a slip assembly engaging said product tubing and a lower interior shoulder within said adapter for supporting a stripper rubber also engaging said production tubing, said adapter further comprising a plurality of removable barrels extending radially outwardly from the generally cylindrical wall of said adapter, said barrels containing hold down screws selectively extendable into the interior of said adapter for restraining upward motion of said stripper rubber, said adapter wall having a generally circular exterior cross section upon removal of said barrels.

4. A method of modifying a screwed type wellhead of the type having a head, with a radial production outlet port, extending upwardly from a well bore, a continuous annular self sealing stripper rubber seated against an internal shoulder of said head and restrained from upward movement by an attachment sealingly mounted to said head and having a protruding rib of smaller inner cross sectional dimension that the outer cross sectional dimension of said stripper rubber, said method comprising:

removing said attachment and said stripper rubber from said head;

sealingly screwing an adapter to said head, said adapter having a lower shoulder, an upper shoulder and a plurality of removable barrels extending radially from said adapter, each barrel having a hold down screw extendable into said adapter;

seating a replacement continuous annular self sealing stripper rubber having an outer diameter larger than said lower shoulder and smaller than said upper shoulder within said adapter against said lower shoulder, said stripper rubber having an interior opening sized and configured to sealingly engage a production tubing;

extending said hold down screws to restrain said replacement stripper rubber from upward motion;

inserting a slip assembly within said adapter against said upper shoulder, said slip assembly being sized and configured to grip and support said same production tubing; and mounting a top piece to said adapter.

5. A method of modifying a screwed type wellhead of the type having a head, with a radial production outlet port, extending upwardly from a well bore, a slip assembly seated against an internal shoulder of said head, a top piece threadedly mounted on said head and a packing disposed between said slip assembly and top piece, comprising:

removing said top piece, packing and slip assembly from said head;

sealingly screwing an adapter, having a generally continuous wall perforated to receive hold down screws, to said head, said adapter having a lower shoulder and a plurality of said hold down screws extendable into said adapter;

seating a replacement continuous annular self sealing stripper rubber within said adapter against said lower shoulder, said stripper rubber having an interior opening sized and configured to sealingly engage a production tubing;

extending said hold down screws to restrain said replacement stripper rubber from upward motion;

inserting one of said slip assembly and a replacement slip assembly within said adapter against said upper shoulder, said one of said slip assembly and a replacement slip assembly being sized and configured to grip and support said same production tubing;

inserting a packing atop said one of said slip assembly and replacement slip assembly; and mounting one of said top piece and a replacement top piece to said adapter.

* * * * *

UNITED STATES PATENT AND TRADEMARK OFFICE

CERTIFICATE OF CORRECTION

PATENT NO. : 4,541,490

DATED : September 17, 1985

INVENTOR(S) : B. N. Bigbie et al

It is certified that error appears in the above-identified patent and that said Letters Patent are hereby corrected as shown below:

Column 1, line 60 delete "uwpardly" and insert -- upwardly --.

Column 4, line 41 delete "to" first occurrence and insert -- be --.

Column 5, line 14 after "laterally" insert -- or --.

Column 6, line 25 delete "in" and insert -- to --.

Column 7, line 33 after the "string" insert a period.

Column 7, line 54 delete "beiing" and insert -- being --.

Signed and Sealed this

*Third* Day of *June 1986*

[SEAL]

*Attest:*

DONALD J. QUIGG

*Attesting Officer*

*Commissioner of Patents and Trademarks*